US008063767B2

(12) United States Patent
Daley

(10) Patent No.: US 8,063,767 B2
(45) Date of Patent: Nov. 22, 2011

(54) COMMUNICATIONS INTERFACE ACCESSORY FOR POWER SYSTEM ARRESTER

(75) Inventor: Charles William Daley, Olean, NY (US)

(73) Assignee: Cooper Technologies Company, Houston, TX (US)

( * ) Notice: Subject to any disclaimer, the term of this patent is extended or adjusted under 35 U.S.C. 154(b) by 1127 days.

(21) Appl. No.: 11/586,953

(22) Filed: Oct. 26, 2006

(65) Prior Publication Data

US 2008/0100403 A1 May 1, 2008

(51) Int. Cl.
*G08B 1/08* (2006.01)

(52) U.S. Cl. ..... 340/538; 340/310.01; 340/311.1

(58) Field of Classification Search ..... 340/538, 340/533, 310.01, 311.1, 310.02, 310.03, 340/309.6, 310.04, 310.05–310.08
See application file for complete search history.

(56) References Cited

U.S. PATENT DOCUMENTS

| | | | | |
|---|---|---|---|---|
| 4,975,797 | A * | 12/1990 | Veverka et al. | 361/35 |
| 5,392,184 | A * | 2/1995 | Unterlass et al. | 361/16 |
| 5,434,550 | A * | 7/1995 | Putt | 337/31 |
| 5,864,284 | A | 1/1999 | Sanderson | |
| 5,923,518 | A * | 7/1999 | Hensley | 361/117 |
| 5,991,141 | A * | 11/1999 | Mikli et al. | 361/127 |
| 6,040,759 | A | 3/2000 | Sanderson | |
| 6,249,415 | B1 * | 6/2001 | Daoud et al. | 361/117 |
| 6,392,861 | B1 * | 5/2002 | Trinh et al. | 361/117 |
| 6,683,531 | B2 | 1/2004 | Diamanti et al. | |
| 6,876,289 | B2 * | 4/2005 | Lenk et al. | 337/30 |
| 7,116,007 | B2 | 10/2006 | Cern | |
| 7,522,812 | B2 * | 4/2009 | Zitting | 385/147 |
| 2003/0218549 | A1 * | 11/2003 | Logvinov et al. | 340/870.07 |
| 2004/0057563 | A1 * | 3/2004 | Chang et al. | 379/90.01 |
| 2006/0082219 | A1 * | 4/2006 | Gerszberg et al. | 307/1 |
| 2007/0014529 | A1 * | 1/2007 | Zitting | 385/147 |

* cited by examiner

*Primary Examiner* — Daniel Previl
(74) *Attorney, Agent, or Firm* — King & Spalding LLP

(57) ABSTRACT

A communications interface accessory for an electric power system arrester is described. The communications interface accessory includes a housing and a communications interface positioned within the housing. The communications interface is configured to complete a signal path with the arrestor. The communications interface accessory also includes a disconnect device positioned within the housing, whereby the disconnect device is coupled to the arrestor and the communications interface.

51 Claims, 12 Drawing Sheets

COMMUNICATIONS INTERFACE ACCESSORY FOR POWER SYSTEM ARRESTER

BACKGROUND OF THE INVENTION

This invention relates generally to electric power system arresters, and more specifically to communications interface accessories for electric power system arresters.

An arrester is a protective device utilized as part of electric power transmission and distribution, which is commonly connected in parallel with a comparatively expensive piece of electrical equipment so as to shunt or divert over-voltage-induced current surges safely around the equipment, thereby protecting the equipment and its internal circuitry from damage. When exposed to an over-voltage condition, the arrester operates in a low-impedance mode that provides a current path to electrical ground having a relatively low impedance. The arrester otherwise operates in a high-impedance mode that provides a current path to ground having a relatively high impedance. The impedance of the current path is substantially lower than the impedance of the equipment being protected by the arrester when the arrester is operating in the low-impedance mode, and is otherwise substantially higher than the impedance of the protected equipment. Upon completion of the over-voltage condition, the arrester returns to operation in the high-impedance mode. This prevents normal current at the system frequency from following the surge current to ground along the current path through the arrester.

To remove a short circuit of line potential conductors connected to the arrester upon an arrester failure, a disconnect device is provided between the arrester and electrical ground. This type of disconnect device is sometimes referred to as a disconnector, or an isolator, and such devices are commercially available from Cooper Power Systems of Waukesha, Wis. Known disconnectors may include an internal resistor connected in parallel with a spark gap assembly, and a black powder charge in an unprimed .22 caliber cartridge that is heat activated. Thus, if the arrester was to fail and a sustained current was to flow through the disconnector, a spark would be generated by the spark gap assembly. Heat from the spark would detonate the powder charge and mechanically sever an electrical connection between the arrester and electrical ground. Short circuit conditions through the arrester may therefore be removed.

Electrical power transmission and distribution equipment typically is configured to deliver electricity from a power station or generator to customers. However, electric power systems have also been used to transmit and receive communications signals. For example, power lines have been used by utility companies to transmit and receive communications signals to monitor equipment and to read meters. Power lines have also been used to provide broadband communications for customers. These communications may be referred to as broadband over power line (BPL) communications. Various techniques have been developed to couple broadband communications signals to medium-voltage power lines. These broadband communications signals typically occupy frequencies in the 2-50 MHz region. One approach to coupling communications signals to these medium-voltage power lines is to use the intrinsic capacitance of metal oxide varistor (MOV) arresters to couple a portion of the communications radio frequency signals onto medium-voltage power lines.

DETAILED DESCRIPTION OF THE INVENTION

In order to appreciate the benefits of the invention to its full extent, the disclosure herein will be segmented into different parts. Part I discusses known disconnectors for high-voltage arresters and problems associated therewith. Part II discusses exemplary embodiments of improved communications interface accessories.

I. Introduction to the Invention

Electric power transmission and distribution equipment is subject to voltages within a fairly narrow range under normal operating conditions, and the equipment may operate at high voltages of, for example, 1000V or greater. However, system disturbances, such as lightning strikes and switching surges, may produce momentary or extended voltage levels that greatly exceed the levels experienced by the equipment during normal operating conditions. These voltage variations often are referred to as over-voltage conditions, or transient voltages. If not protected from over-voltage conditions, critical and expensive equipment, such as transformers, switching devices, computer equipment, and electrical machinery, may be damaged or destroyed by over-voltage conditions and associated current surges. Accordingly, it is routine practice for system designers to use arresters to protect system components from dangerous over-voltage conditions.

As mentioned previously, arresters are commonly connected in parallel with a comparatively expensive piece of electrical equipment. While the arresters normally exhibit a high impedance, when an over-voltage event occurs the arresters switch to a low-impendence state so as to shunt or divert over-voltage-induced current to electrical ground. Damaging currents are therefore diverted safely around the equipment, thereby protecting the equipment and its internal circuitry from damage.

Figure 1:
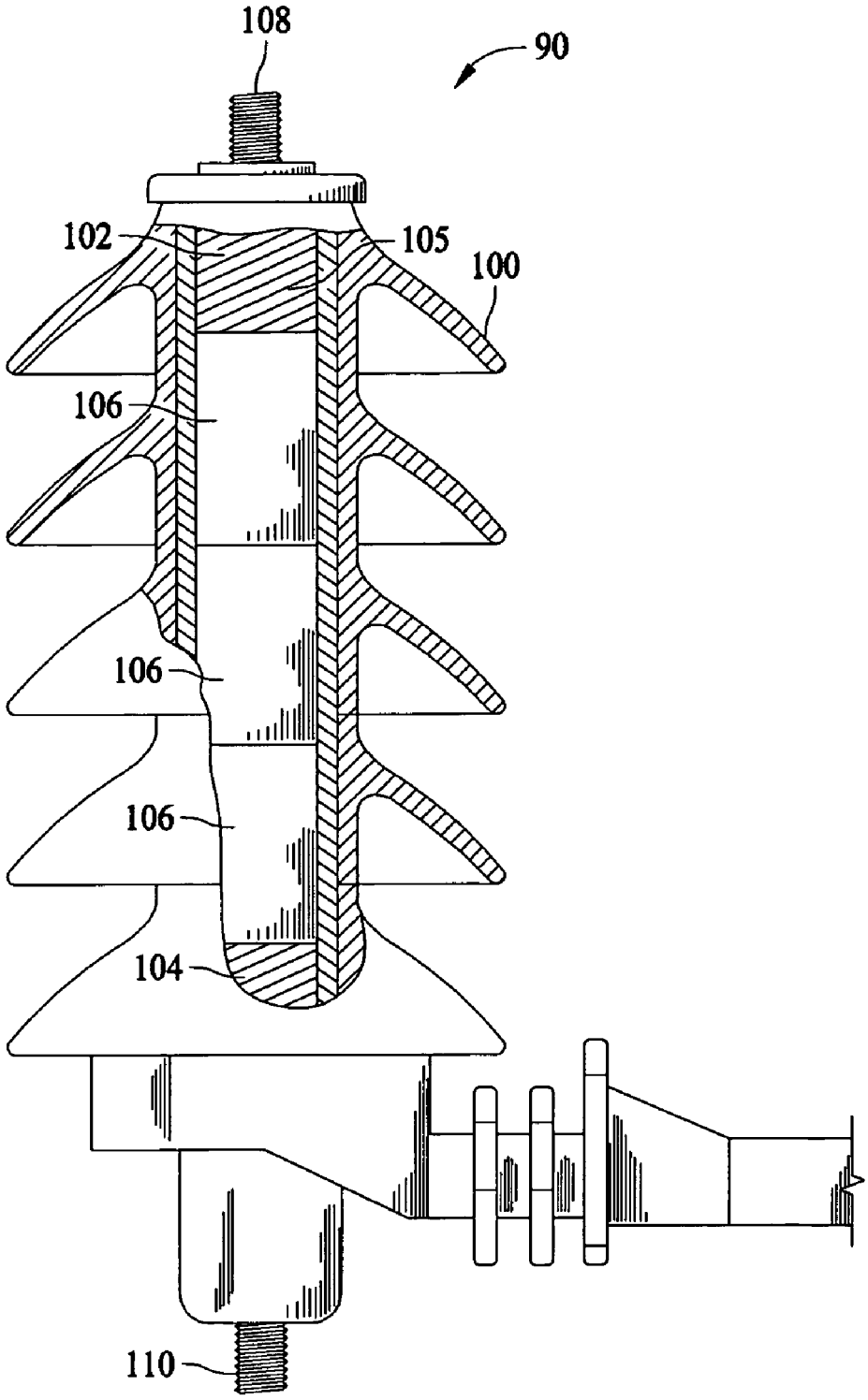
FIG. 1 (Prior Art)
FIG. 1 is a side elevation view partly broken away of a known electric power system arrester including a disconnector and hanger.

As illustrated in FIG. 1, a high-voltage arrester 90 typically includes an elongated outer enclosure or housing 100 made of an electrically insulating material, a pair of electrical terminals 102 and 104 at opposite ends of the enclosure 100 for connecting the arrester between a line-potential conductor and electrical ground, respectively, and a stack or array 105 of other electrical components 106 that form a series electrical path between the terminals 102 and 104. Terminal connectors 108 and 110 connect to the line and ground terminals 102 and 104, respectively.

The components 106 typically include a stack of voltage-dependent, nonlinear resistive elements, referred to as varistors. A varistor is characterized by having a relatively high resistance when exposed to a normal operating voltage, and a much lower resistance when exposed to a larger voltage, such as is associated with over-voltage conditions. The varistors may be, for example, metal oxide varistors. In addition to varistors, one or more spark gap assemblies may be housed within the insulative enclosure 100 and electrically connected in series with the varistors. Also, in addition to the varistor elements, such components including, for example, resistors, capacitors, insulators and fuse links may be provided in the stack or array 105. Some arresters also include electrically conductive spacer elements coaxially aligned with the varistors and gap assemblies. An insulated mounting bracket or hanger 112 may also be provided for mounting of the arrester 90 to, for example, another piece of equipment or to a utility pole.

To remove a short circuit from line-potential conductors connected to a failed arrester 90, a disconnector 114 may be provided.

Figure 2:
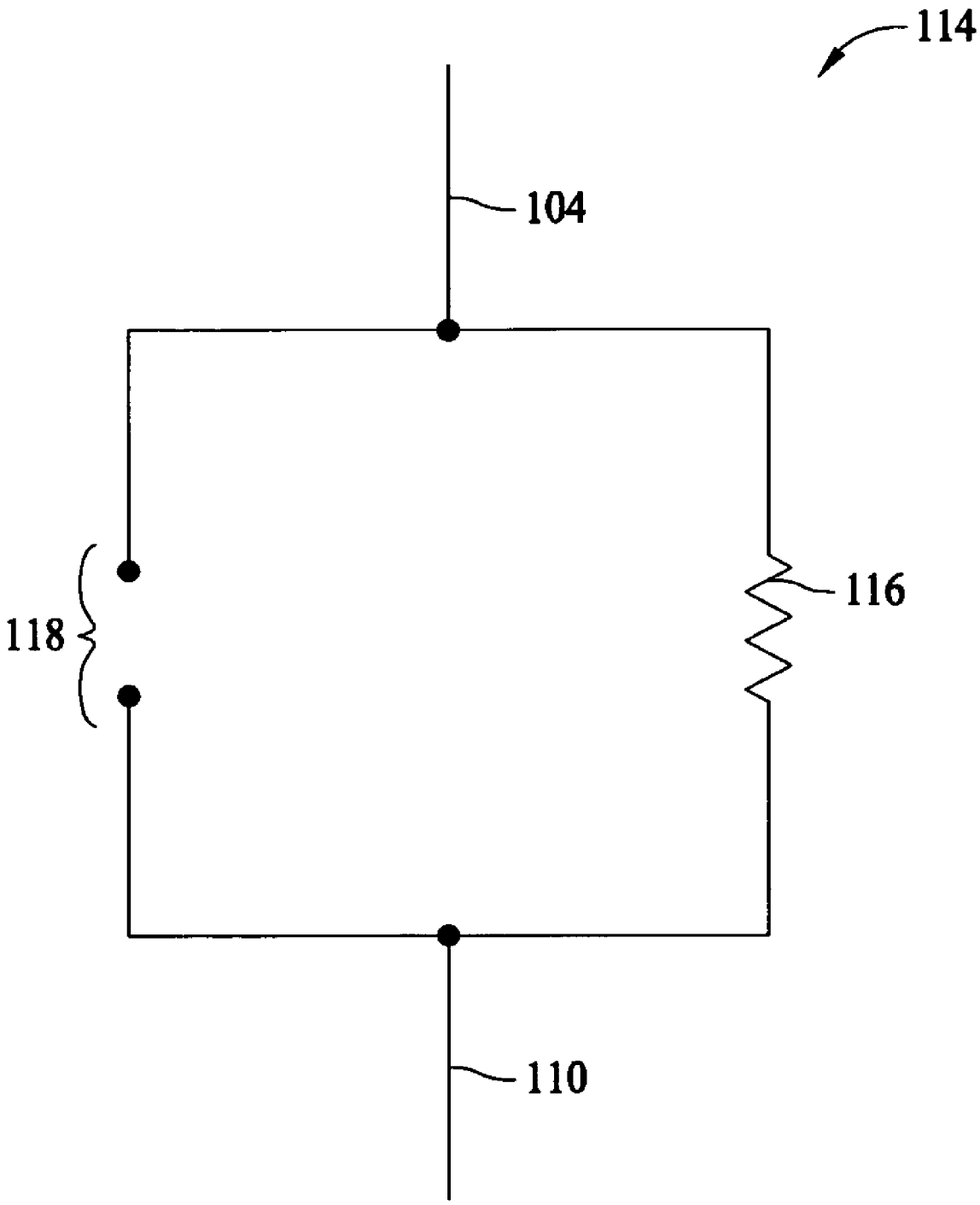
FIG. 2 (Prior Art)
FIG. 2 is a circuit diagram of the disconnector shown in FIG. 1.

FIG. 2 is a circuit diagram of a known disconnector 114. In accordance with known disconnectors, the disconnector 114 may include an internal resistor 116 connected in parallel with a spark gap assembly 118, and a black powder charge in an unprimed .22 caliber cartridge (not shown in FIG. 2) that is heat activated. Thus, if the arrester 90 fails and a sustained current flows through the terminal connector 110, a spark is generated by the spark gap assembly 118. Heat from the spark detonates the powder charge to mechanically sever the electrical connection between the terminal connector 110 and the lower terminal 104 in the housing 100, thereby isolating the terminal connector 110 from the line connection. Short circuit conditions through the arrester 90 may therefore be removed.

Along with transmitting power, it is possible to configure an electric power transmission and distribution system to also transmit broadband communications signals over electric power lines. One technique to couple broadband communication devices to electric power systems is to use the intrinsic capacitance of an arrester to couple a communications device to the electric power system.

In order to configure an electric power transmission and distribution system to transmit and receive broadband communications signals using the above technique, a communications interface, also referred to as a communications coupler or communications accessory, may be attached to the arrester. The communications interface provides a connection between an electric power system and a communications device. Currently, to install a communications interface to an arrester, a disconnector is removed to allow connection of the communications interface to the ground end of the arrester. Once this is completed, the disconnector is reinstalled. Time and labor associated with this process is undesirable, and removal of the disconnector from the arrester can be difficult because the disconnector is securely connected to the arrester to ensure proper functionality. Moreover, if the disconnector is not properly reinstalled, reliability and performance issues with the disconnector may result.

While the disconnector 114 has so far been described and illustrated in connection with a particular type of high-voltage arrester 90 that is believed to be representative of typical arresters, it is to be understood that a variety of different types of known arresters include such disconnectors and all may experience the communications interface installation challenges noted above. The challenges noted above are therefore not considered unique to any particular disconnector, such as the disconnector 114, or to any particular arrester, such as the arrester 90.

II. Exemplary Embodiments of the Invention

A first embodiment of the invention provides a communications interface accessory, which includes a disconnector and a communications interface, for an arrester such as the arrester 90 shown in FIG. 1. Producing a communications interface accessory that includes a disconnector and a communications interface reduces difficulties associated with removal and re-installation of the disconnector from an arrester, as well as reduces the time and labor required to complete connections to a BPL system.

Figure 3:
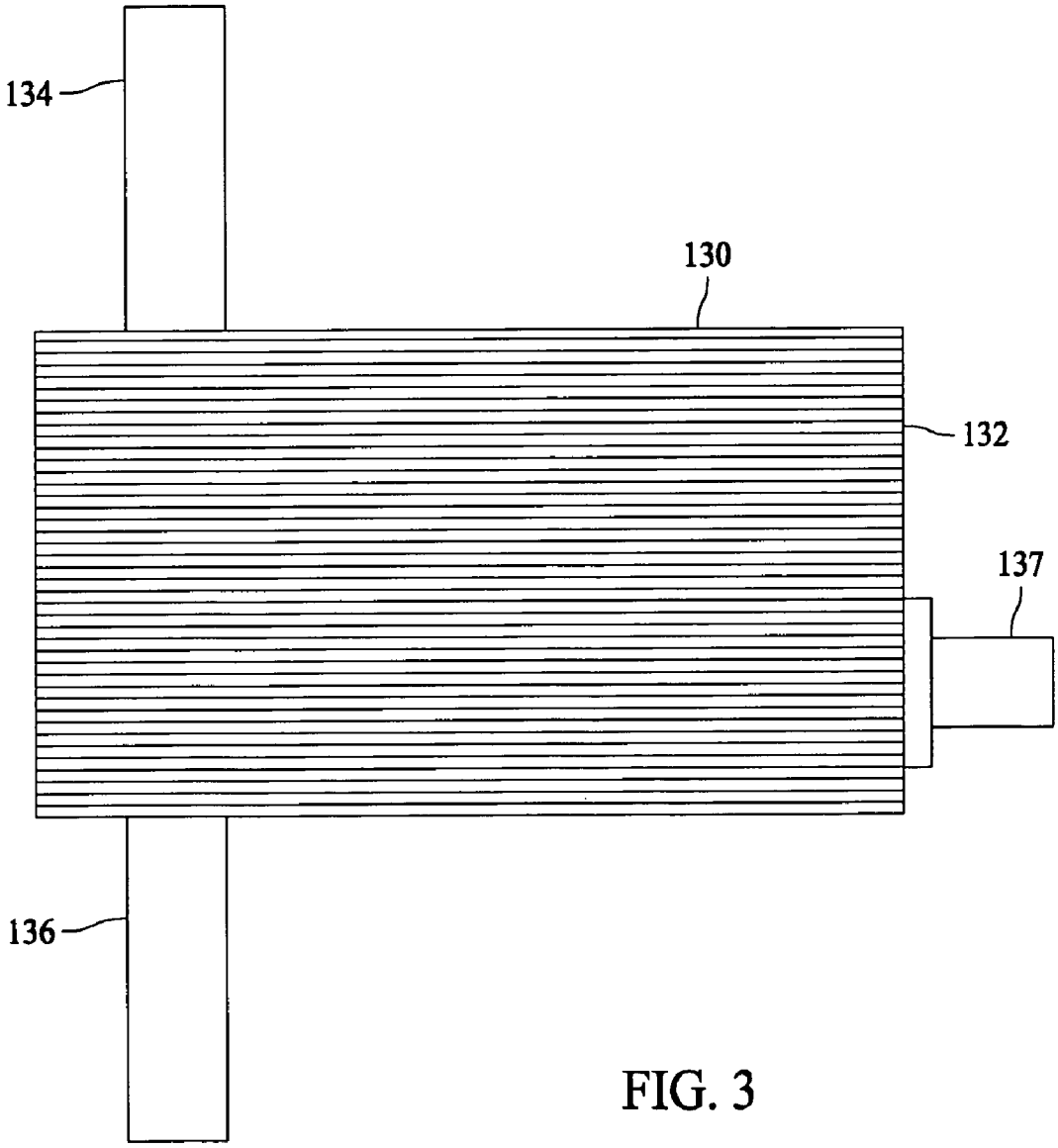
FIG. 3 is a side view of a first exemplary embodiment of a communications interface accessory that includes a disconnector and a communications interface of the invention.

FIG. 3 is a side view of a first exemplary embodiment of a communications interface accessory 130. The communications interface accessory 130 may include a disconnector (not shown in FIG. 3) and an integrated communications interface (not shown in FIG. 3). The communications interface accessory 130 may include an enclosure or housing 132 including a first terminal 134, a second terminal 136, and a communications connector 137 extending therefrom. While the first and second terminals 134 and 136 are illustrated extending from a top and a bottom surface of the housing 132, and the communications connector 137 is shown extending from an end of the housing 132, in other embodiments the first and second terminals 134 and 136, as well as the communications connector 137, may extend from other surfaces of the housing 132.

The housing 132 may be formed using a potting process. This process may include coating the contents of the housing 132 with a potting compound that forms the housing 132. Alternatively, the housing 132 may also be formed using an overmolding process or other known techniques. Regardless of the technique used to form the housing 132, the housing 132 surrounds and encases both the disconnector (not shown in FIG. 3) and the communications interface (not shown in FIG. 3). The housing 132 is configured to surround and protect the communications interface accessory 130 from precipitation, wind, debris, and contaminants. The first and second terminals 134 and 136 may be threaded stud terminals. The communications connector 137 may be a radio frequency coaxial connector, although other types of connectors may be employed in other embodiments.

Figure 4:
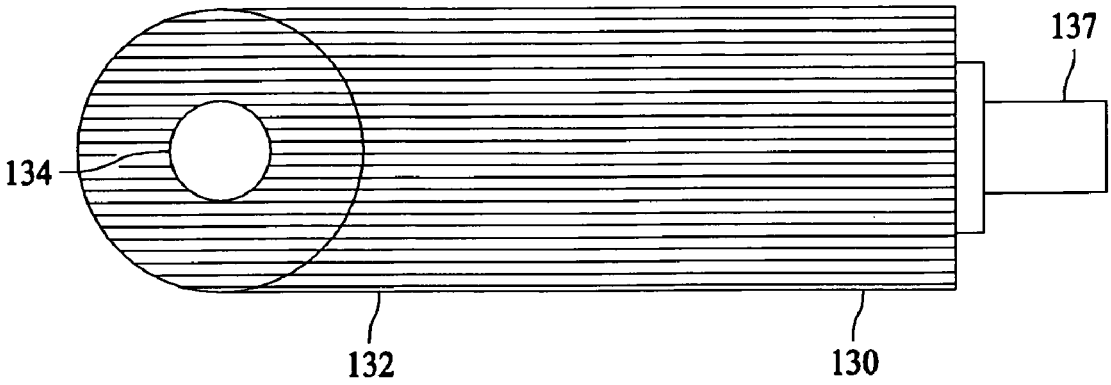
FIG. 4 is a top view of the communications interface accessory shown in FIG. 3.

FIG. 4 is a top view of the communications interface accessory 130. The communications interface accessory 130 may include the housing 132 with the first terminal 134, the second terminal (not shown in FIG. 4), and the communications connector 137 extending therefrom.

Figure 5:
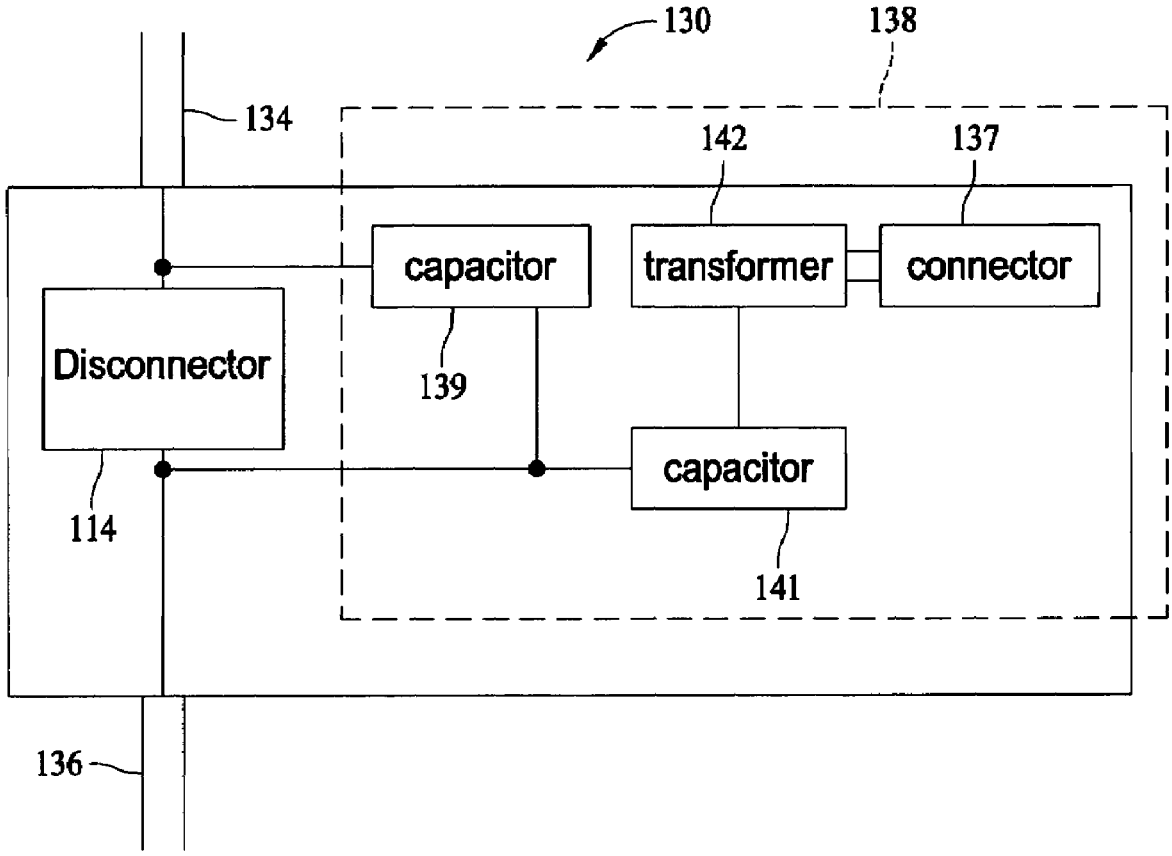
FIG. 5 is a schematic component diagram of the exemplary communications interface accessory of FIGS. 3 and 4.

FIG. 5 is a schematic component diagram of the communications interface accessory 130 of FIGS. 3 and 4. The communications interface accessory 130 may include the disconnector 114 of FIG. 2, positioned between and connecting the first terminal 134 and the second terminal 136. The communications interface accessory 130 also includes a communications interface 138 that enables transmission of broadband communications signals over electric power systems. The communications interface 138 may include a capacitor 139 that bypasses the disconnector 114 and provides a path, in parallel with the disconnector 114, between the first terminal 134 and the second terminal 136. The capacitor 139 is an exemplary embodiment of a parallel bypass that improves the transmission efficiency of the communications interface accessory 130. The capacitor 139 may broadly represent a circuit path in parallel with disconnector 114. In another exemplary embodiment, a copper wire is configured to provide this bypass path. The high-impedance of disconnector 114 may cause degradation of radio frequency signals, which interferes with efficient operation of a BPL system. In operation, the capacitor 139 provides a path that separates radio frequency signals from low frequency signals. More specifically, the capacitor 139 provides a path for radio frequency signals from the electric power system to bypass the disconnector 114, while low frequency signals flow through the disconnector 114 to the second terminal 136. The bypass path may reduce radio frequency signal degradation that may occur if the disconnector 114 is not bypassed.

The communications interface 138 may also include a capacitor 141 and a transformer 142, the combination of which provides a series connection between the communications connector 137 and at least one of the first and second terminals 134 and 136 of the communications interface accessory 130.

Figure 6:
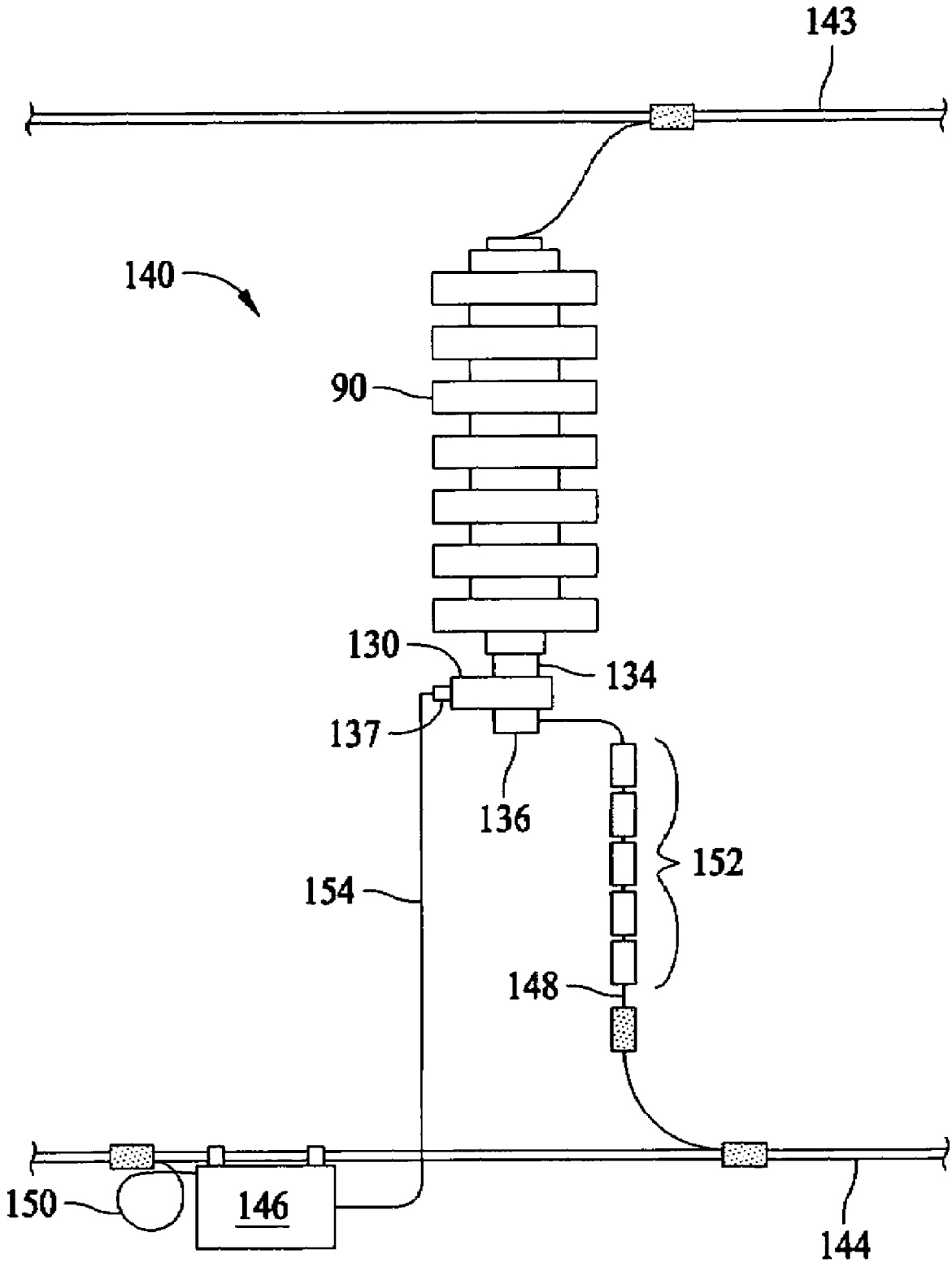
FIG. 6 illustrates the exemplary communications interface accessory of FIGS. 3-5, attached to the arrester of FIG. 1.

FIG. 6 illustrates an example portion of a BPL system 140. FIG. 6 illustrates the first embodiment of the communications interface accessory 130 connected to the arrester 90. The BPL system 140 includes an electric power system 143, which in an example embodiment is at least one of a high-voltage power line and a medium-voltage power line. The BPL system 140 also includes the arrester 90, which is positioned between the electric power system 143 and an electrically ground line 144. The arrester 90 may also be positioned between the electric power system 143 and a communications device 146. The communications device 146 may be a regenerator unit, a transceiver, and a modem. In an exemplary embodiment, the communications device 146 may enable multiple end-users to connect with the BPL system 140 and transmit and/or receive broadband communications signals.

Within the BPL system 140, the first terminal 134 of the communications interface accessory 130 may be configured to connect with the arrester 90. Also, as described above, the communications interface accessory 130 may include the communications connector 137. A low-voltage communications line 154 may be coupled to the communications connector 137, completing an electrical path between the arrester 90 and the communications device 146. A conductor 150 may ground the communications device 146. A conductor 148, along with ferrites 152, may be configured to provide a connection between the second terminal 136 of the communications interface accessory 130 and the electrically ground line 144. The second terminal 136 may be configured to connect the communications interface accessory 130 to electrical ground 144. In operation, the communications interface 138 (not shown in FIG. 6) of communications interface accessory 130 allows communications signals to be communicated between the electric power system 143 and the communications device 146 through the arrester 90.

The communications interface accessory 130 is configured to match the impedances of the electric power system 143 and the communications device 146. The transformer 142 may be an impedance matching transformer. In an exemplary embodiment, the electric power system 143 may have an impedance in the range from 350-450 ohms and the low-voltage communications line 154 (and/or communications device 146) may have an impedance in the range from 50-75 ohms. In certain embodiments, to match impedances, impedance transformer 30 may represent a transformer with a step-up ratio of approximately 8:1, such as for example a Mini Circuits T8-1 transformer. In certain embodiments, the capacitor 141 may have a capacitance in the range of 0.01 to 0.1 microfarads and the capacitor 141 may have a working capacity greater than 300 volts. For example, in a particular embodiment, the capacitor 141 may represent a 0.047 microfarad 600 volt coupling capacitor. Although example embodiments including the impedance transformer 142 and the capacitor 141 have been described as having certain characteristics or ranges of characteristics, any appropriate components may be used to match (or improve the matching of) impedances within BPL system 140 without departing from the spirit and scope of the present invention. In certain embodiments, for example, BPL system 140 and/or communications interface accessory 130 may include different connection topologies and/or different types of impedance transformers 142. In a particular embodiment, certain functions of the present invention may be accomplished using a transmission line transformer.

The conductor 148 may represent any appropriate wire or cable, such as, for example, a standard #4 or #6 AWG solid copper wire. In embodiments including the conductor 148, one or more ferrites 152 may be coupled to the conductor 148 so that the one or more ferrites substantially surround a portion of the conductor 148. In operation, the ferrites 152 may serve as a low-pass filter preventing (or attenuating) the transmission of high-frequency signals through the portion of the conductor 148 coupled to the one or more ferrites 152. Although the embodiment shown includes ferrites 152, in certain alternative embodiments, any suitable device may be used to provide this filtering function.

As described above, the communications interface accessory 130 not only may remove a short circuit condition of line potential conductors connected to the arrester 90 upon a failure of the arrester 90, but also may couple the communications device 146 to the arrester 90. In certain embodiments, the communications interface accessory 130 is electrically coupled to the communications device 146 through the use of the low-voltage communications line 154. In certain embodiments, the low-voltage communications line 154 may represent any appropriate single or multi-conductor cable or wire. For example, in certain embodiments, the low-voltage communications line may represent a coaxial cable, an Ethernet cable, a telephone cable, or a serial cable. In certain embodiments, the low-voltage communications line 154 may represent two or more single or multi conductor cables and/or wires. In certain embodiments, the communications interface accessory 130 is electrically coupled to the arrester 90 through a connector. In particular embodiments, the communications interface accessory 130 may include the first terminal 134 that may include a feature allowing for connection to arrester 90. The communications interface accessory 130 may be positioned directly adjacent to (or integral to) the arrester 90, directly adjacent to (or integral to) the communications device 146, and/or in any other appropriate position with respect to the communications device 146 and the arrester 90.

In certain embodiments, the communications interface accessory 130 may provide an impedance match between the electric power system 143 (and/or the arrester 90) and the low-voltage communications line 154 (and/or the communications device 146). For example, in certain embodiments, the communications interface accessory 130 may include one or more capacitors and one or more impedance transformers to provide this impedance matching function. Further description of embodiments of the communications interface accessory 130 including one or more capacitors and one or more impedance transformers is provided below in relation to FIG. 7. Although, certain embodiments of the communications interface accessory 130 are described herein as including one or more capacitors and one or more impedance transformers, in other embodiments the communications interface accessory 130 may include other appropriate components and/or techniques to provide this impedance matching function.

Figure 7:
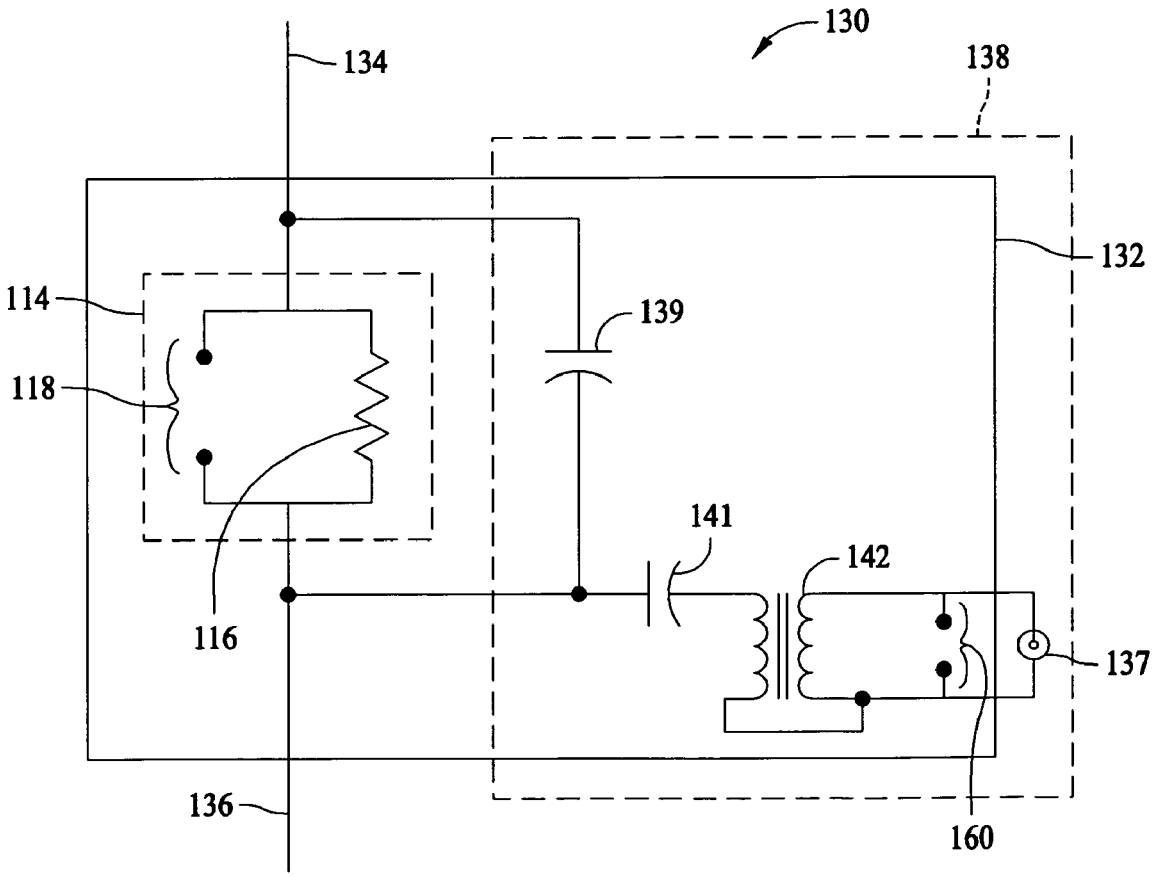
FIG. 7 is a circuit diagram of the exemplary communications interface accessory of FIGS. 3-5.

FIG. 7 is a circuit diagram of the communications interface accessory 130 shown in FIGS. 3-6. The communications interface accessory 130 may include the disconnector 114 and the communications interface 138. The communications interface accessory 130 may include the housing 132 that encases both the disconnector 114 and the communications interface 138. The communications interface accessory 130 may include the disconnector 114 of FIG. 2, which includes the spark gap assembly 118 and the resistor 116, connected in parallel between the first terminal 134 and the second terminal 136. The communications interface accessory 130 also may include the communications interface 138 that enables transmission of broadband communications signals over the electric power system 143 (not shown in FIG. 7). The communications interface 138 may include the capacitor 139 that bypasses the disconnector 114 and provides a path, in parallel with the disconnector 114, between the first terminal 134 and the second terminal 136. The communications interface 138 may also include a capacitor 141 and a transformer 142, which in combination provide a series connection between the communications connector 137 and at least one of the first terminal 134 and the second terminal 136 of the communications interface accessory 130.

The communications interface may also include a protection element 160. In an exemplary embodiment, the protection element 160 may be a spark gap assembly. The protection element 160 is configured to protect a communications device (not shown in FIG. 7) from a transient voltage, which may damage the communications device. Should a transient voltage, or a voltage above a predetermined level that is considered to be capable of damaging the communications device, reach protection element 160, the protection element 160 creates a short circuit that prevents the transient voltage from reaching the communications device.

Figure 8:
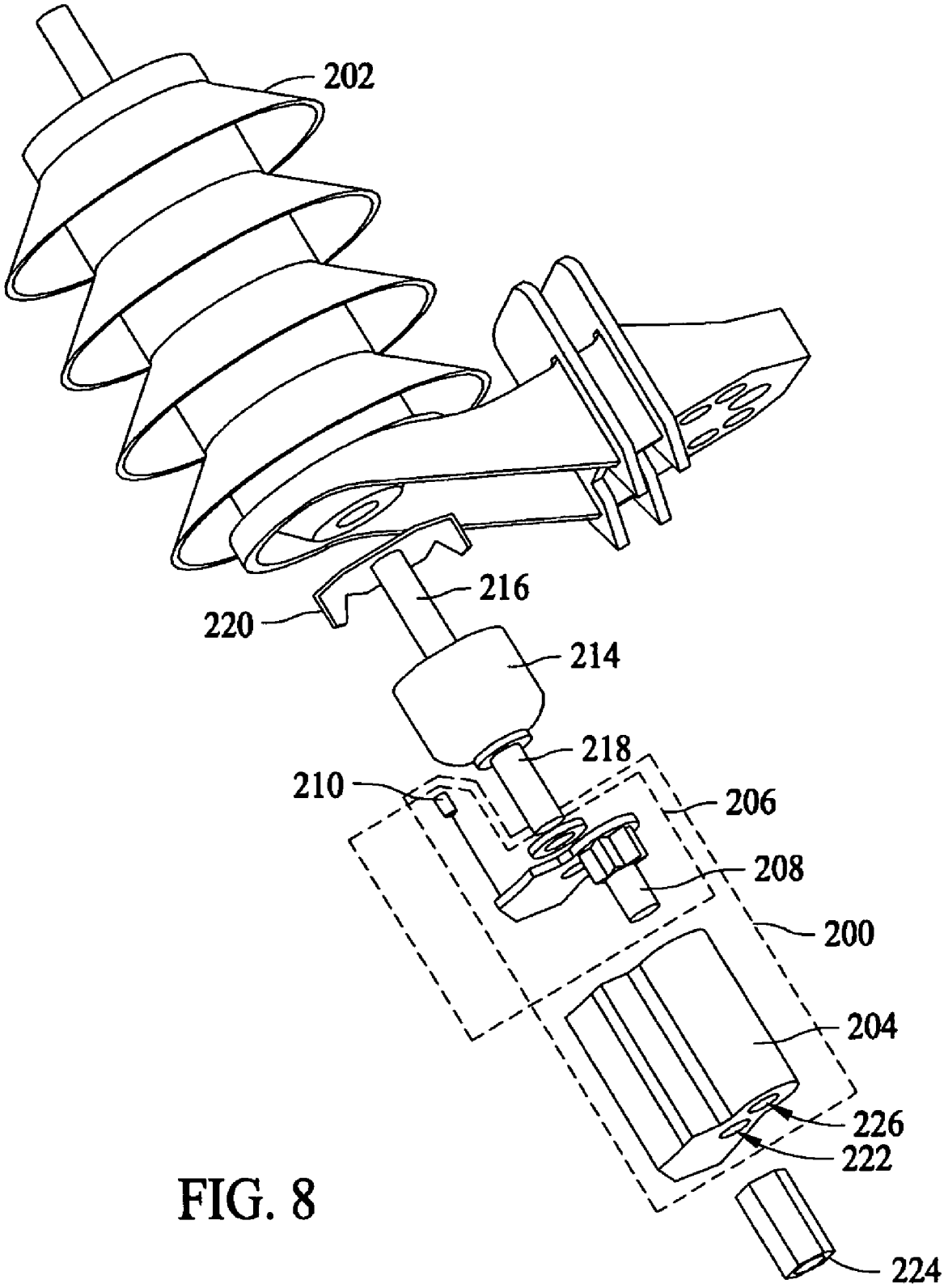
FIG. 8 is an exploded view of a second exemplary embodiment of a communications interface accessory and an exemplary arrester.

FIG. 8 illustrates an exploded view of a second exemplary embodiment of a communications interface accessory 200 and an exemplary arrester 202. The communications interface accessory 200 may include a housing 204 and a communications interface 206. However, in contrast to the first exemplary embodiment of communications interface accessory 130, the second exemplary embodiment of the communications interface accessory 200 does not include a disconnector within the housing 204. Rather, the communications interface accessory 200 may be configured to receive and provide electrical connections to a disconnector, but the disconnector and the communications interface 206 are not packaged together as in the first exemplary embodiment of the communications interface accessory 130. The communications interface 206 may be encased within the housing 204. The communications interface 206 may include a communications connector 208 and a disconnector bypass conductor 210. The communications interface 206 may be configured to facilitate injecting radio frequency communications signals into an electric power system (not shown in FIG. 8) in a similar manner to that described above.

The communications accessory 200 may be configured to receive a disconnector 214 that includes a first terminal 216, a second terminal 218, and a disconnector bypass connector 220. The disconnector bypass connector 220 may be configured to be electrically coupled to the first terminal 216. The disconnector bypass connector 220 may also be configured to be electrically coupled to the disconnector bypass conductor 210. The housing 204 may also include an opening 222 configured such that the second terminal 218 may extend from the housing 204. The communications interface 206 may be configured such that it is held within housing 204 by a combination of the second terminal 218 and a fastener 224. Alternatively, the communications interface 206 may be held within housing 204 by a potting compound that encapsulates the communications interface components. The housing 204 also may include an opening 226 configured such that the communications connector 208 may extend from the housing 204.

Figure 9:
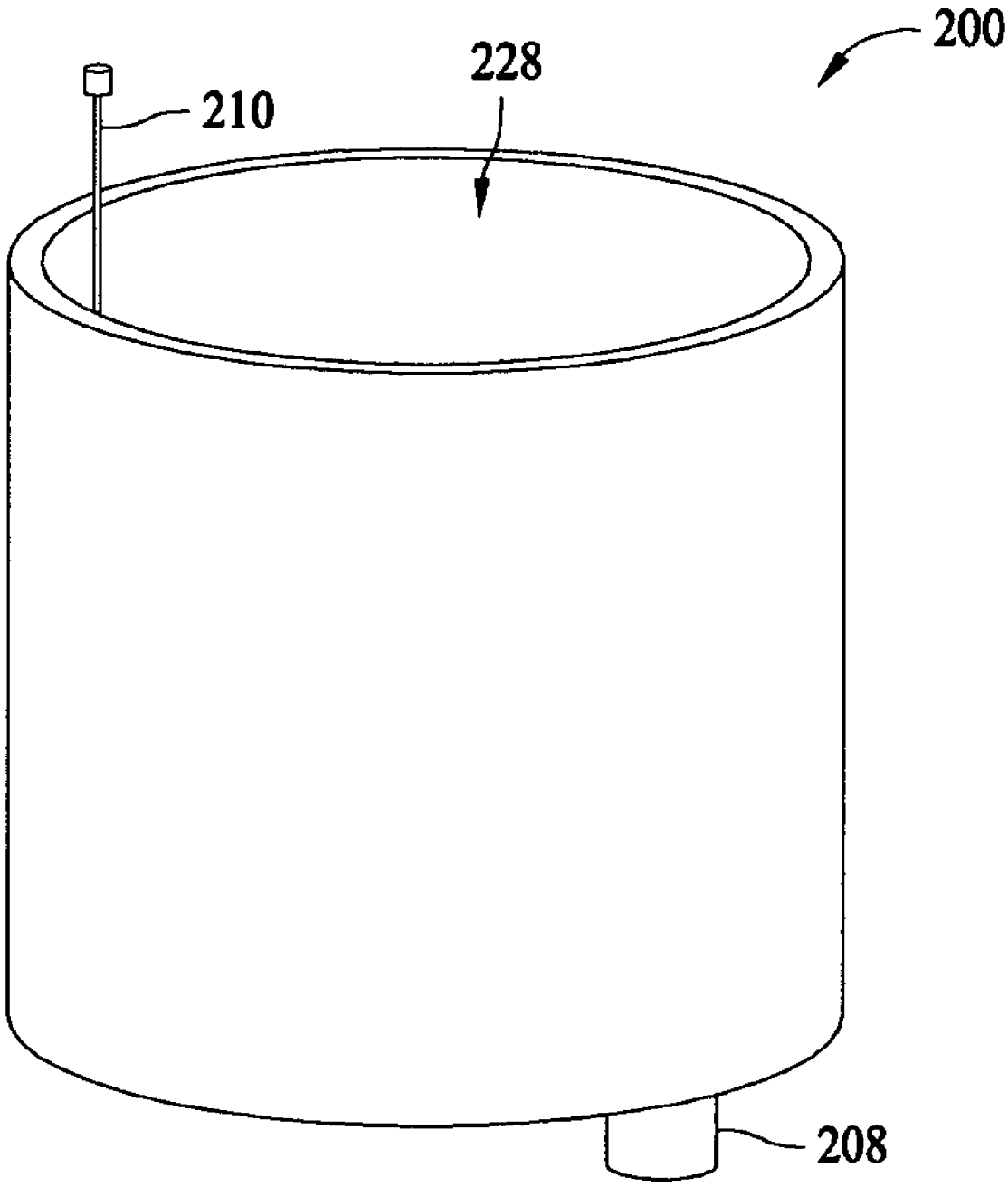
FIG. 9 is a top perspective view of a second exemplary embodiment of a communications interface accessory.

FIG. 9 is a top perspective view of the second exemplary embodiment of the communications interface accessory 200. The communications interface accessory 200 may include a cup-shaped housing defining a disconnector opening 228 dimensioned to receive a disconnector, for example, the disconnector 214 described above. The communications interface accessory 200 may also include the disconnector bypass conductor 210 that provides radio frequency signals with a path from the arrester 202 (not shown in FIG. 9) to the communications connector 208, without flowing through the disconnector 214 (not shown in FIG. 9). As described above, this alternate path around the disconnector 214 may preserve radio frequency signal fidelity by bypassing the disconnector 214, where radio frequency signal degradation may occur.

Figure 10:
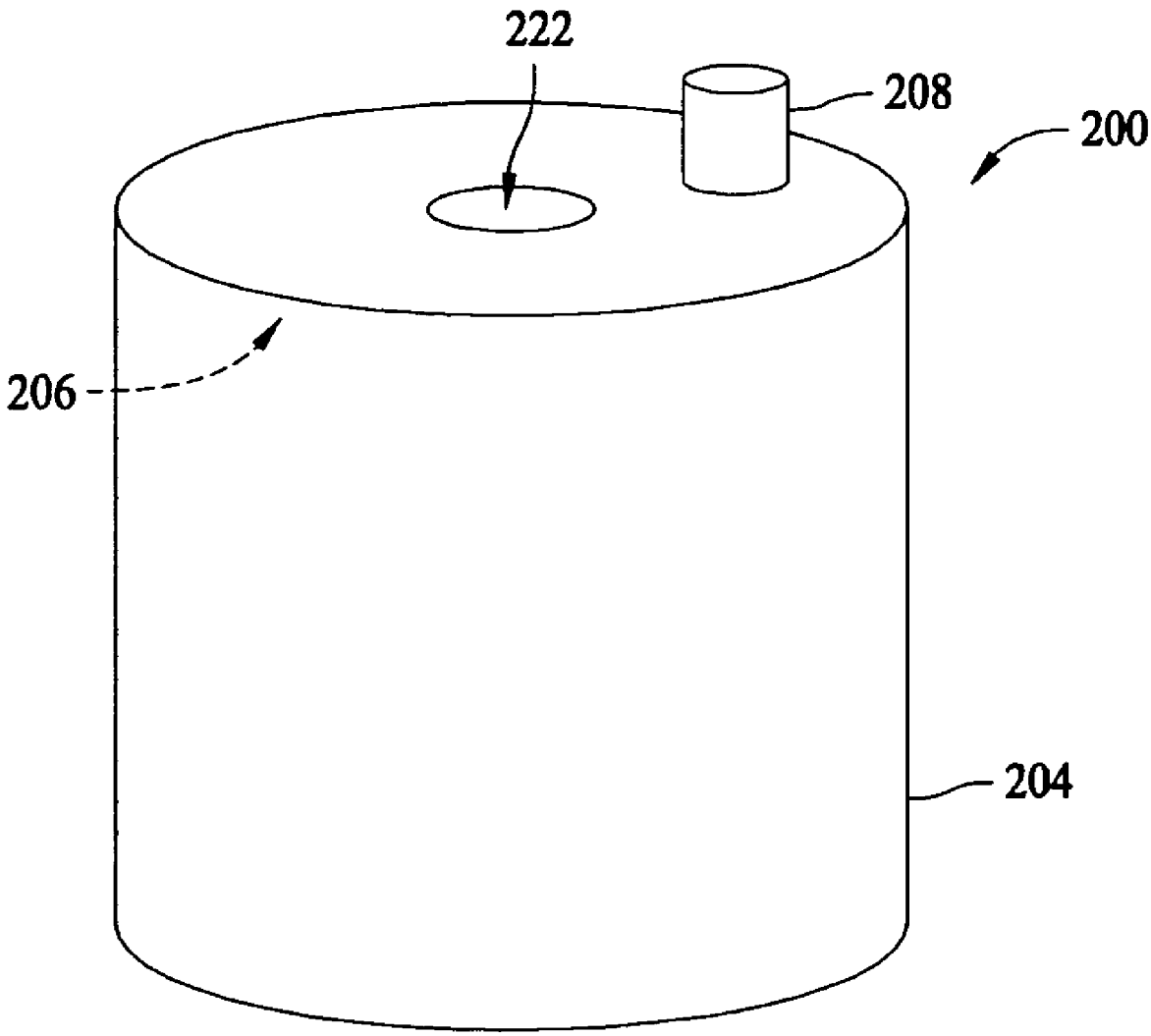
FIG. 10 is a bottom perspective view of the communications interface accessory shown in FIG. 9.

FIG. 10 is a bottom perspective view of the communications interface accessory 200 shown in FIG. 9. The communications connector 208 of the communications interface accessory 200 may extend from the housing 204. The housing 204 may also include the opening 222. The opening 222 may provide access between an interior and an exterior of the housing and may be configured to couple the second terminal 218 of the disconnector 214 (not shown in FIG. 10) to the communications interface 206, which is located in the interior of the housing 204. The opening 222 is also configured such that the second terminal 218 (not shown in FIG. 10) may extend from the housing 204.

Figure 11:
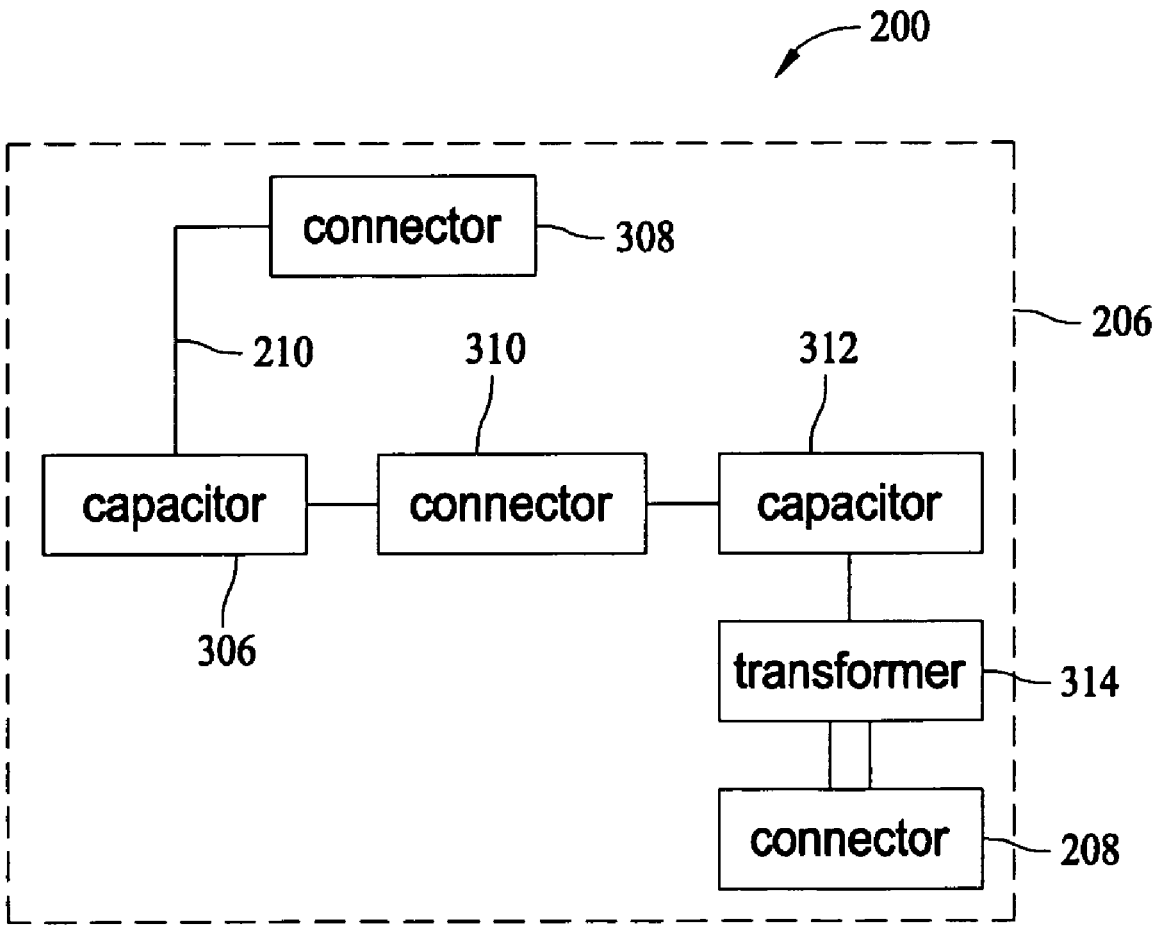
FIG. 11 is a schematic component diagram of the exemplary communications interface accessory of FIGS. 8-10.

FIG. 11 is a schematic component diagram of the communications interface 206 of the second exemplary embodiment of the communications interface accessory 200. The communications interface 206 is configured to enable transmission of broadband communications signals over electric power systems. The communications interface 206 may include a capacitor 306 coupled to the disconnector bypass conductor 210, which is described above. The disconnector bypass conductor 210 may include a bypass connector 308 configured to electrically couple the disconnector bypass conductor 210 to a terminal of a disconnector, for example, the first terminal 216 of the disconnector 214 (not shown in FIG. 11). The bypass connector 308 may also be configured to electrically couple the disconnector bypass conductor 210 to the disconnector bypass connector 220, which may provide an electrical connection to the first terminal 216. The communications interface 206 may also include a terminal connector 310 configured to receive a terminal of a disconnector, for example, the second terminal 218 of the disconnector 214 (not shown in FIG. 11).

The communications interface 206 may also include a capacitor 312 and a transformer 314, the combination of which provides a series connection between the communications connector 208 and terminal connector 310. The transformer 314 may be configured to match the impedance of the electrical power system and the communications connector 208.

Figure 12:
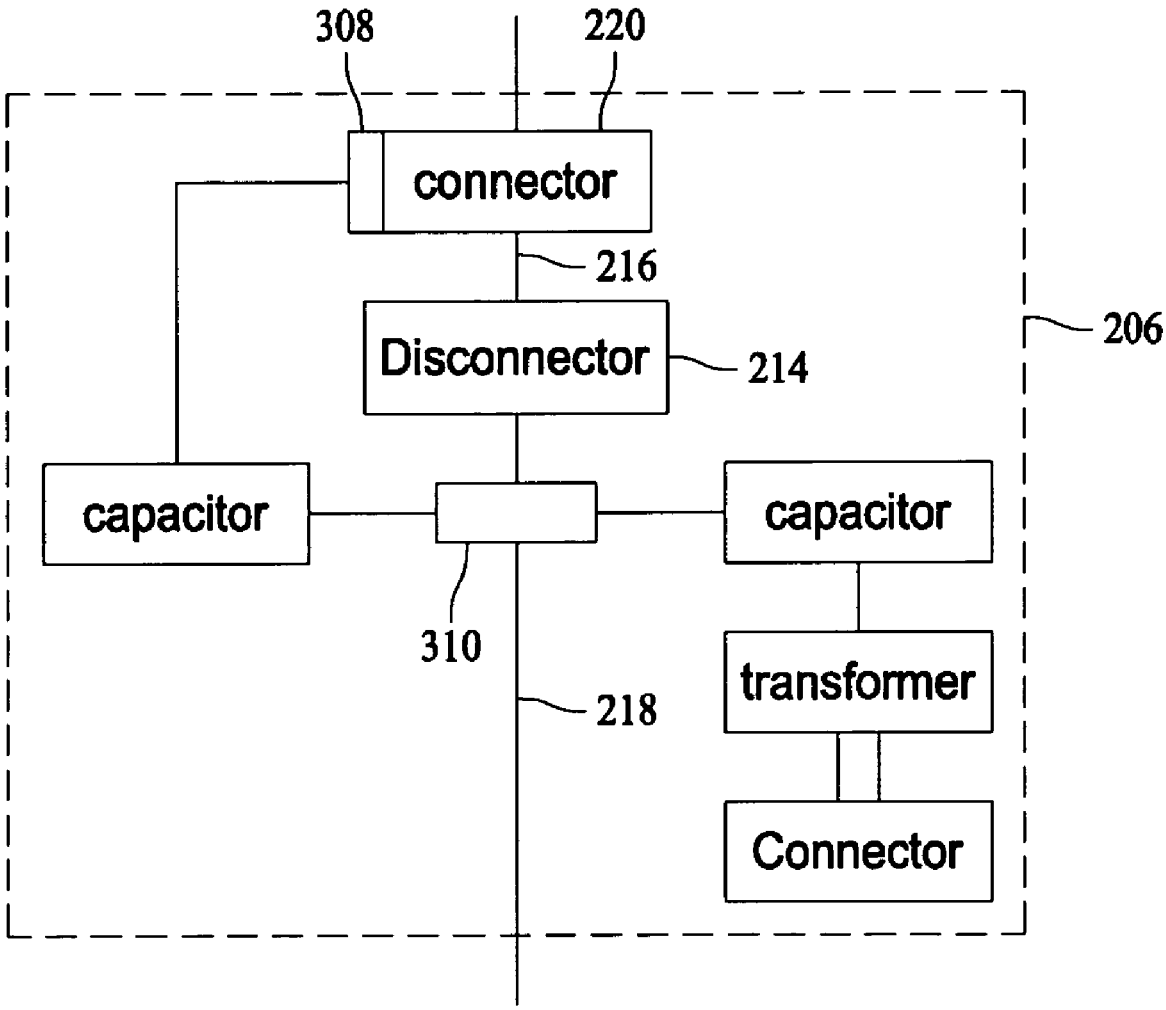
FIG. 12 is a component diagram of the communications interface accessory shown in FIG. 11, coupled to a disconnector.

FIG. 12 is a component diagram of the second exemplary embodiment of the communications interface 206, coupled to a disconnector. The disconnector 214 may be electrically coupled to the communications interface 206. More specifically, the first terminal 216 of the disconnector 214 may be electrically coupled to the communications interface 206 by the bypass connector 308 in combination with the bypass connector 220. Also, the second terminal 218 of the disconnector 214 may be electrically coupled to the communications interface 206 by the terminal connector 310.

Figure 13:
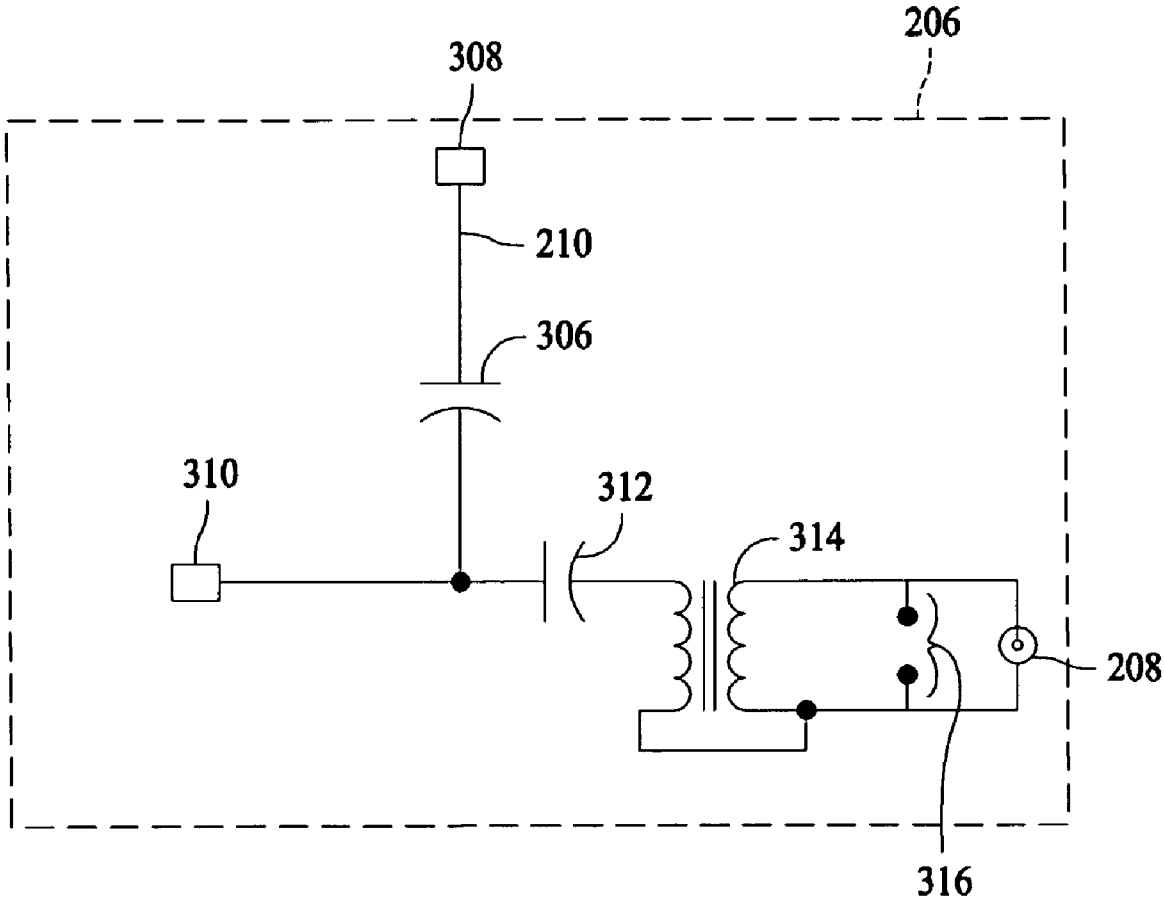
FIG. 13 is a circuit diagram of the communications interface accessory shown in FIGS. 8-10.

FIG. 13 is a circuit diagram of the communications interface 206 of the second exemplary embodiment of the communications interface accessory 200. The communications interface 206 may include the capacitor 306, which in combination with the disconnector bypass conductor 210 and the disconnector bypass connector 308, bypasses a disconnector (not shown in FIG. 13) when a disconnector is installed. This bypass may preserve radio frequency signal fidelity by bypassing the disconnector 214, where radio frequency signal degradation may occur. The communications interface 206 may also include the capacitor 312 and the transformer 314, which in combination provide a series connection between the communications connector 208 and at least one of the terminal connector 310 and the disconnector bypass conductor 210. The communications interface 206 may also include a protection element 316. In an exemplary embodiment, protection element 316 may be a spark gap assembly, as described above with regard to the protection element 160.

Producing a communications interface accessory that in a first exemplary embodiment includes a disconnector and a communications interface packaged together within a single housing, and in a second exemplary embodiment includes a communications interface packaged within a housing, wherein the housing is configured to receive a disconnector, reduces the time and labor required to complete connections to a BPL system. Encasing a disconnector and a communications interface within a single package, or providing a communications interface accessory that is designed to receive a disconnector, also reduces difficulties associated with removal and re-installation of the disconnector from an arrester, as is currently required to complete a BPL system that includes an arrester. By providing a communications interface accessory that includes a disconnector and a communications interface packaged together within a single housing or designed with connections to ease the coupling of a disconnector and a communications interface, the opportunity for human error while assembling a BPL system is reduced. Also, forming a communications interface accessory by surrounding a disconnector and a communications interface with a housing, for example, a potting compound, protects the connections and components from such potential causes of damage as precipitation, wind, debris, and contaminants. Furthermore, the housing may include design elements that include drainage features.

One embodiment of a communications interface accessory for an electric power system arrester is disclosed herein that comprises a housing and a communications interface encased within the housing. The communications interface may be configured to complete a signal path with the arrester.

Optionally, the communications interface accessory may further comprise a disconnector encased in the housing, the disconnector configured to mechanically sever a conductive path between the arrester and a ground level conductor. The communications interface may comprise radio frequency components comprising at least one of an impedance matching transformer, a low-voltage communications line, a capacitor, and a coaxial connector. The communications interface accessory may further comprise a spark gap assembly configured to protect the communications device from a transient voltage. Also, the disconnector may comprise a spark assembly and a powder charge. Furthermore, the communications interface may further comprise a bypass capacitor configured to couple the arrester to the communications interface.

Another embodiment of a communications interface accessory for an electric power system arrester is also disclosed herein. The accessory comprises: a housing; a first terminal extending from the housing; a second terminal extending from the housing; an operating element encased within the housing and connected between the first and second terminals that is adapted to mechanically sever a conductive path between the first and second terminals; and a communications interface encased within the housing and configured to complete a current path to one of the first and second terminals.

Optionally, the communications interface may be further configured to complete a current path to a communications device. The communications interface may comprise an impedance matching transformer. The communications interface may also comprise radio frequency components. The radio frequency components may comprise at least one of a low-voltage communications line, a capacitor, and a coaxial connector. The communications interface accessory may further comprise a spark gap assembly configured to protect the communications device from a transient voltage. The operating element may comprise a spark gap assembly and a powder charge. The powder charge may comprise an unprimed .22 caliber cartridge. The communications interface accessory may further comprise a bypass capacitor connecting the first and second terminals. The housing may comprise a potting compound configured to encase the communications interface assembly.

An embodiment of an electric power system arrester is also disclosed herein. The electric power system arrester comprises at least one varistor having a first terminal and a second terminal, and a communications interface accessory connected to one of the first and second terminals of the at least one varistor. The communications interface accessory comprises a disconnector and a communications interface encased in a housing.

Optionally, the communications interface may be configured to complete a current path to a communications device. The communications interface may comprise an impedance matching transformer. The communications interface may also comprise radio frequency components. The radio frequency components may, comprise at least one of a low-voltage communications line, a capacitor, and a coaxial connector. The communications interface may further comprise a protection element configured to protect the communications device. The disconnector may comprise a spark gap assembly and a powder charge. The powder charge may comprise an unprimed .22 caliber cartridge. The electric power system arrester may further comprise a radio frequency bypass capacitor, electrically coupling a first and a second terminal of the disconnector, and configured to separate radio frequency signals from low frequency signals. Furthermore, the housing may comprise a potting compound surrounding at least one of the disconnector and the communications interface.

An embodiment of a communications interface accessory configured for communications over electric power systems is also disclosed herein. The communications interface accessory comprises: a communications interface adapted to couple the communications interface accessory to a communications device; a disconnect device adapted to couple the communications interface accessory to an arrester; and a bypass connector adapted to couple the communications interface to the arrester.

Optionally, the communications interface accessory may further comprise a housing. The housing may be configured to encase the communications interface, the bypass connector, and the disconnect device. The disconnect device may comprise a spark gap assembly and a powder charge. The bypass connector and the disconnect device may provide parallel electric paths between an electric power system and the communications interface. The communications interface may comprise radio frequency components. The communications interface may further comprise a protection element configured to protect the communications device.

Another embodiment of a communications interface accessory for an electric power system arrester is also disclosed herein. The accessory comprises a communications interface configured to complete a current path between a communications device and the arrester, and a housing encasing the communications interface and configured to receive a disconnector.

Optionally, the communications interface may comprise a connector configured to provide an electrical connection between the disconnector and the communications interface. The communications interface may comprise an impedance matching transformer. The communications interface may also comprise radio frequency components. The radio frequency components may comprise at least one of a low-voltage communications line, a capacitor, and a coaxial connector. The communications interface may comprise a bypass conductor configured to provide a path between the arrester and the communications connector for radio frequency signals. The housing may comprise a potting compound encasing the communications interface and forming a receptacle configured to receive the disconnector. The housing may also comprise at least one opening configured to receive at least one of the communications connector and a terminal of the disconnector.

An embodiment of an electric power system arrester is also disclosed herein that comprises at least one varistor having a first terminal and a second terminal, and a communications interface accessory connected to one of the first and second terminals of the at least one varistor. The communications interface accessory comprises a communications interface encased in a housing.

Optionally, the communications interface accessory may further comprise a disconnector encased in the housing. The disconnector may be configured to mechanically sever a conductive path between the arrester and a ground level conductor. The housing may comprise a potting compound configured to encase the communications interface accessory. The communications interface may be configured to couple a communications device to an electric power system. The communications interface may comprise radio frequency components. The radio frequency components may comprise at least one of an impedance matching transformer, a low-voltage communications line, a capacitor, and a coaxial connector. The communications interface may comprise a spark gap assembly configured to protect the communications device from a transient voltage. The communications interface may further comprise a bypass capacitor configured to couple the arrester to the communications interface. Also, the disconnector may comprise a spark assembly and a powder charge.

While the invention has been described in terms of various specific embodiments, those skilled in the art will recognize that the invention can be practiced with modification within the spirit and scope of the claims.

What is claimed is:

1. A communications interface accessory for an electric power system arrester, the accessory comprising:

a housing; and a communications interface encased within the housing, the communications interface configured to complete a signal path with the arrester, wherein the communications interface provides a path that separates radio frequency signals from low frequency signals, and wherein the communications interface enables transmission of the radio frequency signals over electric power systems.

2. A communications interface accessory according to claim 1, wherein the communications interface accessory further comprises a disconnector encased in the housing, the disconnector configured to mechanically sever a conductive path between the arrester and a ground level conductor.

3. A communications interface accessory according to claim 2, wherein the disconnector comprises a spark assembly and a powder charge.

4. A communications interface accessory according to claim 2, wherein the communications interface further comprises a bypass capacitor configured to couple the arrester to the communications interface.

5. A communications interface accessory according to claim 1, wherein the communications interface comprises radio frequency components.

6. A communications interface accessory according to claim 5, wherein the radio frequency components comprise at least one of an impedance matching transformer, a low-voltage communications line, a capacitor, and a coaxial connector.

7. A communications interface accessory according to claim 1, further comprising a spark gap assembly configured to protect the communications device from a transient voltage.

8. A communications interface accessory for an electric power system arrester, the accessory comprising:

a housing;

a first terminal extending from the housing;

a second terminal extending from the housing;

an operating element encased within the housing and connected between the first and second terminals, the operating element comprising a spark gap assembly for mechanically severing a conductive path between the first and second terminals; and a communications interface encased within the housing and configured to complete a current path to one of the first and second terminals, wherein the communications interface comprises a protection element for creating a short circuit, wherein the communications interface provides a path that separates radio frequency signals from low frequency signals, and wherein the communications interface enables transmission of the radio frequency signals over electric power systems.

9. A communications interface accessory according to claim 8, wherein the communications interface is further configured to complete a current path to a communications device.

10. A communications interface accessory according to claim 8, wherein the communications interface comprises an impedance matching transformer.

11. A communications interface accessory according to claim 8, wherein the communications interface comprises radio frequency components.

12. A communications interface accessory according to claim 11, wherein the radio frequency components comprise at least one of a low-voltage communications line, a capacitor, and a coaxial connector.

13. A communications interface accessory according to claim 8, wherein the protection element comprises a second spark gap assembly configured to protect the communications device from a transient voltage.

14. A communications interface accessory according to claim 8, wherein the operating element comprises a powder charge.

15. A communications interface accessory according to claim 14, wherein the powder charge comprises an unprimed .22 caliber cartridge.

16. A communications interface accessory according to claim 8, further comprising a bypass capacitor connecting the first and second terminals.

17. A communications interface accessory according to claim 8, wherein the housing comprises a potting compound configured to encase the communications interface assembly.

18. An electric power system arrester comprising:

at least one varistor having a first terminal and a second terminal; and a communications interface accessory connected to one of the first and second terminals of the at least one varistor, the communications interface accessory comprising a disconnector and a communications interface encased in a housing, wherein the disconnector comprises a spark gap assembly and a resistor, wherein the communications interface comprises a protection element for protecting a communications device, wherein the communications interface provides a path that separates radio frequency signals from low frequency signals, wherein the radio frequency signals bypass the resistor, wherein the low frequency signals flow through the resistor, and wherein the communications interface enables transmission of the radio frequency signals over electric power systems.

19. An electric power system arrester according to claim 18, wherein the communications interface is configured to complete a current path to a communications device.

20. An electric power system arrester according to claim 18, wherein the communications interface comprises an impedance matching transformer.

21. An electric power system arrester according to claim 18, wherein the communications interface comprises radio frequency components.

22. An electric power system arrester according to claim 21, wherein the radio frequency components comprise at least one of a low-voltage communications line, a capacitor, and a coaxial connector.

23. An electric power system arrester according to claim 18, wherein the disconnector comprises a powder charge.

24. An electric power system arrester according to claim 23, wherein the powder charge comprises an unprimed .22 caliber cartridge.

25. An electric power system arrester according to claim 18, further comprising a radio frequency bypass capacitor.

26. An electric power system arrester according to claim 18, wherein the housing comprises a potting compound surrounding at least one of the disconnector and the communications interface.

27. A communications interface accessory comprising:

a communications interface adapted to couple the communications interface accessory to a communications device, wherein the communications interface provides a path that separates radio frequency signals from low frequency signals, wherein the communications interface enables transmission of radio frequency signals over electric power systems;

a disconnect device adapted to couple the communications interface accessory to an arrester; and a bypass connector adapted to couple the communications interface to the arrester.

28. A communications interface accessory according to claim 27, further comprising a housing.

29. A communications interface accessory according to claim 28, wherein the housing is configured to encase the communications interface, the bypass connector, and the disconnect device.

30. A communications interface accessory according to claim 27, wherein the disconnect device comprises a spark gap assembly and a powder charge.

31. A communications interface accessory according to claim 27, wherein the bypass connector and the disconnect device provide parallel electric paths between an electric power system and the communications interface.

32. A communications interface accessory according to claim 27, wherein the communications interface comprises radio frequency components.

33. A communications interface accessory according to claim 27, wherein the communications interface further comprises a protection element configured to protect the communications device.

34. A communications interface accessory for an electric power system arrester, the accessory comprising:

a communications interface configured to complete a signal path between a communications device and the arrester, wherein the communications interface provides a path that separates radio frequency signals from low frequency signals, and wherein the communications interface enables transmission of radio frequency signals over electric power systems; and a housing encasing the communications interface and configured to receive a disconnector, wherein the disconnector comprises a spark gap assembly, and wherein the communications interface comprises a protection element for protecting the communications device.

35. A communications interface accessory according to claim 34, wherein the communications interface comprises at least one connector configured to provide an electrical connection between the disconnector and the communications interface.

36. A communications interface accessory according to claim 34, wherein the communications interface comprises an impedance matching transformer.

37. A communications interface accessory according to claim 34, wherein the communications interface comprises radio frequency components.

38. A communications interface accessory according to claim 37, wherein the radio frequency components comprise at least one of a low-voltage communications line, a capacitor, and a coaxial connector.

39. A communications interface accessory according to claim 34, wherein the communications interface comprises a bypass conductor configured to provide a path between the arrester and the communications connector for radio frequency signals.

40. A communications interface accessory according to claim 34, wherein the housing comprises a potting compound encasing the communications interface and forming a receptacle configured to receive the disconnector.

41. A communications interface accessory according to claim 34, wherein the housing comprises at least one opening configured to receive at least one of the communications connector and a terminal of the disconnector.

42. An electric power system arrester comprising:

at least one varistor having a first terminal and a second terminal; and a communications interface accessory connected to one of the first and second terminals of the at least one varistor, the communications interface accessory comprising a communications interface encased in a housing, wherein the communications interface provides a path that separates radio frequency signals from low frequency signals, wherein the communications interface enables transmission of radio frequency signals over electric power systems.

43. An electric power system arrester according to claim 42, wherein the communications interface accessory further comprises a disconnector encased in the housing.

44. An electric power system arrester according to claim 43, wherein the disconnector is configured to mechanically sever a conductive path between the arrester and a ground level conductor.

45. An electric power system arrester according to claim 43, wherein the disconnector comprises a spark assembly and a powder charge.

46. An electric power system arrester according to claim 42, wherein the housing comprises a potting compound configured to encase the communications interface accessory.

47. An electric power system arrester according to claim 42, wherein the communications interface is configured to couple a communications device to an electric power system.

48. An electric power system arrester according to claim 42, wherein the communications interface comprises radio frequency components.

49. An electric power system arrester according to claim 48, wherein the radio frequency components comprise at least one of an impedance matching transformer, a low-voltage communications line, a capacitor, and a coaxial connector.

50. An electric power system arrester according to claim 42, wherein the communications interface comprises a spark gap assembly configured to protect the communications device from a transient voltage.

51. An electric power system arrester according to claim 42, wherein the communications interface further comprises a bypass capacitor configured to couple the arrester to the communications interface.

* * * * *